United States Patent [19]

Rosander

[11] Patent Number: 4,757,545

[45] Date of Patent: Jul. 12, 1988

[54] AMPLIFIER CIRCUIT FOR A CONDENSER MICROPHONE SYSTEM

[76] Inventor: Rune Rosander, Helsingborgsgatan 5, S-265 00 Astorp, Sweden

[21] Appl. No.: 583,129

[22] Filed: Feb. 24, 1984

[30] Foreign Application Priority Data

Feb. 25, 1983 [SE] Sweden ..... 8301061

[51] Int. Cl.[4] ..... H04R 3/06; H04R 9/04

[52] U.S. Cl. ..... 381/92; 381/113; 381/122; 381/191

[58] Field of Search ..... 381/92, 113, 122, 155, 381/191; 179/111 R, 121 D

[56] References Cited

U.S. PATENT DOCUMENTS

| | | | |
|---|---|---|---|
| 2,678,967 | 5/1954 | Grosskopf | 381/113 |
| 3,135,838 | 6/1964 | Wright | 381/191 |
| 4,063,050 | 12/1977 | Carlson et al. | 179/111 E |
| 4,156,800 | 5/1979 | Sear et al. | 381/114 |
| 4,308,425 | 12/1981 | Momose et al. | 381/92 |
| 4,334,740 | 6/1982 | Wray | 381/92 |
| 4,412,097 | 10/1983 | Ishigaki et al. | 381/92 |
| 4,521,908 | 6/1985 | Miyaji | 381/92 |
| 4,559,642 | 12/1985 | Miyaji et al. | 381/92 |

FOREIGN PATENT DOCUMENTS

| | | | |
|---|---|---|---|
| 0065746 | 12/1982 | European Pat. Off. | 179/111 R |
| 2071459 | 9/1981 | United Kingdom | 381/92 |

*Primary Examiner*—Jin F. Ng
*Assistant Examiner*—Danita R. Byrd
*Attorney, Agent, or Firm*—Ladas & Parry

[57] ABSTRACT

A microphone comprising a double membrane condenser unit and an amplifier circuit is connected to a power supply. Signals from the two membranes of the unit are fed to each one amplifier and to each one impedance transformer and are delivered through a signal wire to a power supply unit having phantom power supply. In the power supply unit, the signals are added or subtracted in order to give a continuously variable directional characteristic of a round or eight characteristic and are added or subtracted in different proportions by means of a potentiometer in order to give different degrees of a cardioid characteristic. The microphone can also be used as a stereo microphone by assigning the two signals to the right and the left channel, respectively. For balanced signals an inverting buffer is used and a second impedance transformer.

1 Claim, 2 Drawing Sheets

AMPLIFIER CIRCUIT FOR A CONDENSER MICROPHONE SYSTEM

The present invention relates to a transformer-less condenser microphone of a high quality with the option of a continuously variable directional characteristic.

A condenser microphone having continuously variable directional characteristic from a round characteristic, through a cardioid characteristic to an eight characteristic is previously known from U.S. Pat. No. 2,678,967, cf especially FIG. 13. This specification discloses a capacitance microphone unit provided with two membranes and a rigid body positioned therebetween. The two membranes are polarized in relation to the rigid body with different voltages. The signals from the two membranes are combined and fed to a suitable amplifier, in this case an electronic tube, whereby different directional characteristics are achieved.

This way to change the directional characteristic is still used today. The drawback with this system is that it requires an adjustment of the polarization voltage for changing the directional characteristic. Since the polarization voltage is a high voltage, it can take several seconds before the amplifier circuits have stabilized after such an adjustment. It is evident, therefore, that such adjustments cannot be made during a recording. Furthermore, it is not easy to construct an electret microphone in which the directional characteristic can be changed in this way, since the polarization voltage in this type of microphone is "built in" in the dielectric.

Another drawback of this previously known capacitance microphone is the fact that a transformer has been used, almost exclusively at least in high quality systems, for the impedance match to the following amplifiers etc., and this, as a rule, requires a low output impedance of about 600 Ω. If the properties of those transformers are examined in the treble as well as in the bass, it is astonishing that skilled persons up to now have accepted the high distortion levels generated by the transformers, e.g. due to super-saturation.

A variable directivity microphone comprising several dynamic microphone units is disclosed in the British published patent application No. GB-A-2,071,459. In this patent, microphone, signals from three separate dynamic units are combined in order to generate a variable directivity from non-directivity. However, in such a microphone inevitable difficulties are encountered due to phase differences between the different membranes which must be placed beside each other or at a long distance from each other. These phase differences generate losses in the treble, especially when the sound source is located at the side of the microphone. Such a microphone cannot be used in high quality recordings, but they are frequently used at television recordings in which the sound source is focused upon (zooming).

The object of the present invention is to provide a high-quality microphone of the condenser type having two cooperating membranes in a single unit and minimum noise and distortion.

Another object of the present invention is to provide condenser microphone of the double membrane type, the directivity of which may be controlled from a mixer table or similar during a recording, i.e. continuously with a prevailing recording.

Still another object of the invention is to provide a condenser microphone which is fed by a phantom unit, in which intermodulation due to different current consumption at different sound levels is eliminated and in which the current consumption is very low.

Finally it is an object of the present invention to provide a condenser microphone including a double membrane unit which may be used as a stereo microphone.

These objects are achieved by a microphone unit comprising a condenser microphone unit having two membranes mutually separated by a rigid body to provide a double membrane unit and an amplifier circuit for connection to a power supply unit, a battery unit or similar. The amplifier circuit comprises a separate amplifier for each membrane in order to provide two amplified signals one from each membrane, which signals are fed through a signal wire to the power supply unit in order to be combined and/or connected to a mixer, a tape recorder or similar. The two signals are combined in the power supply unit in order to form the sum or the difference therebetween. The signals are damped in different proportions before combining.

The amplifier circuit comprises a first amplifier having at least one FET transistor and a second amplifier which is an impedance transformer and which lowers the output impedance. The two amplifiers are connected in series regarding the power supply. Preferably, the second amplifier comprises a transistor having an internal resistor of the power supply unit as load resistor. The amplifier circuit comprises a current regulator, which maintains the current consumption at a constant level.

The invention is described in more details below by means of preferred embodiments of the invention by reference to the appended drawings.

Figure 1:
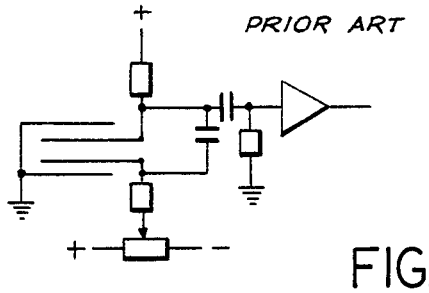
FIG. 1 is a circuit diagram of a condenser microphone according to prior art.

FIG. 1 shows a circuit diagram of a microphone according to the prior art represented by U.S. Pat. No. 2,678,967. In this microphone the signals from the two membranes are added by connecting the two condenser membranes in parallel before connection to the amplifier. However, this parallel connection reduces the available signal level by up to 50% (6 dB) by the fact that the capacitance is doubled as mentioned in said specification. The noise arises from a single amplifier.

In accordance with present invention it is suggested that each membrane is connected to each separate amplifier. Thus, the entire signal strength of each membrane is used and amplified. However, if the microphone is used with round or eight characteristics, both amplifiers contribute to the total noise.

Thus, it is evident that the signal is increased by 6 dB, while the noise is increased by 3 dB according to the present invention compared to conventional microphones, which gives an increase of 3 dB in the S/N-ratio. If the microphone is used as a cardioid, only one membrane and one amplifier contributes to the signal and noise which means an increase of 6 dB in S/N-ratio.

Figure 2:
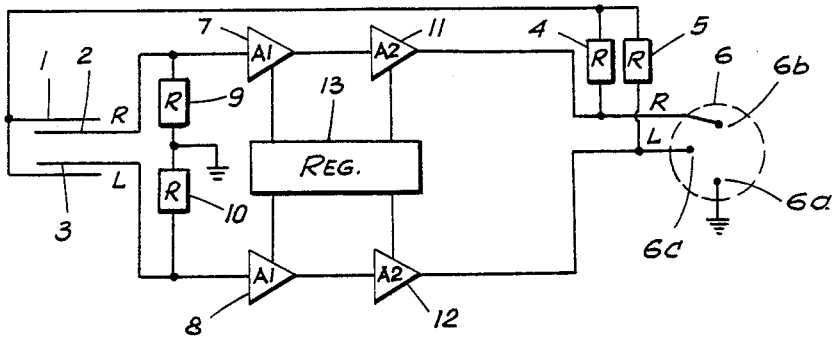
FIG. 2 is a circuit diagram of a first embodiment of the invention.

A first embodiment of the microphone according to the present invention is shown in FIG. 2.

A condenser microphone 1 having two membranes 2, 3 are provided with a high voltage through two high resistors 4 and 5 by means of e.g. so-called phantom feeding through the connector 6, which can be of Canon type. According to standard, the phantom feeding voltage is +48 V, but voltages from about +20 V to +50 V are sometimes used. The signals which are achieved from the condenser microphone unit are essentially proportional to the feeding voltage, and thus, a high feeding voltage is desired in order to achieve a high signal/noise-ratio (S/N). Moreover, as small variation as possible in the feeding voltage is desired.

The signals R and L from the membranes 2 and 3 of the microphone are fed to an amplifier $A_1$ 7, 8, which comprises a FET transistor. The membranes 2 and 3 should be loaded as little as possible and thus, two loading resistors 9, 10 of 100 MΩ has been shown in FIG. 1. Those resistors can be still higher. The input stage of the amplifier $A_1$ should have as low input capacitance as possible, preferably at the most a few pF in order not to load the membrane. Suitably, the amplifier $A_1$ has a rather low voltage amplifying of e.g. 20 to 40 dB, whereby simultaneously a lowering of the impedance is achieved. The amplifier $A_1$ can also have variable amplification, e.g. by means of a switch (which can be remotely controlled) which lowers the amplification with 20 dB for use at extremely high sound levels. The above-mentioned amplification is desired from the view point of noise, since thus, the inherent noise of the input stage will be dominating in the following amplifier chain. The amplifier $A_1$ can be a single FET transistor or possibly a FET transistor combined with one or several further transistors of bipolar or unipolar type. If the amplification in the first FET transistor is more than about 10, the noise requirements on the following components will not be too stringent. If so, the main noise contribution arises from the inherent noise of the FET transistor and the noise from the input circuit, which is essentially the input capacitance (microphone unit parallel with the input capacitance of the FET transistor) in parallel with the load resistor 9, 10. If the input capacitance is large, the noise, especially at low frequencies, will be decreased. Thus, it is essential to select a FET transistor which has low inherent noise together with a low input capacitance, in order not to load the membrane and to decrease the noice contribution from the input circuit. The last requirement will be very important at electret units or a combination of electret and polarization voltage units, since electret units often have a very low capacitance.

After the amplifier $A_1$ a second amplifier $A_2$ 11, 12 is connected essentially as a buffer, i.e. with the amplification 1. In this amplifier a further impedance decrease is achieved to a nominal output impedance below 600 Ω for driving the connection wire.

The amplifier in FIG. 2 comprises moreover a voltage regulator which transforms the input voltage from the phantom supply of the connector 6 to e.g. +12 V for feeding the amplifiers $A_1$ and $A_2$ 7, 8, 11, 12. For the voltage regulator it must be mentioned that the noise contribution from the regulator must be negligible. Moreover, the self-current consumption must be minimal. Thus, a conventional integrated voltage regulator should not be used.

The output signals from the amplifier of the above described microphone are delivered through the connector 6 and are fed through a conventional wire comprising two signal wires and an earth screen to the input connector 15 of a power supply unit 14 or a battery unit. The power supply unit 14 comprises a transformer 16, a rectifying bridge 17 and a filter circuit 18 and delivers +48 V to the contact N. From the contact N, two closely matched resistors 19, 20 of each 6.8 kΩ, according to standard are connected to each one signal terminal of the connector 15. In this way, the phantom feeding takes place through the signal wires with +48 V.

The signals are taken out from the connector 15 through capacitors and are fed to a double ganged potentiometer 21 of e.g. about 1 kΩ. Alternatively two separate potentiometers can be used in order to adjust the sensibility separately for the two directions of the microphone. From the output terminals of the potentiometer, the signals R and L are fed to a buffer 22, 23 having the amplification +1 and a buffer 24, 25 or inverter having the amplification −1. The output signals from those buffers are fed through two switches to the output connector 28 of the power supply unit. If this connector 28 is connected to a balanced input of a subsequent mixer or tape recorder etc. different directional characteristics are achieved from a round, to a cardioid to an eight characteristic in dependence of the position of the slider of the potentiometer 21 and the switches 26, 27. It should be observed that the signal wire R normally is connected to the positive input of the balanced input stage while the signal wire L is connected to the negative input. However, the signals R and L are phase inverted with 180° in relation to each other at a sound signal from the same signal source, since they are faced at directions which differ 180°. If thus both switches 26 and 27 are placed in their upper or lower position seen according to FIG. 2 and the potentiometer 21 is placed in its middle position, the signals L and R will be subtracted in the balanced input and a characteristic which is an eight is achieved. If one of the switches 26 or 27 is placed in its lower position and the other in its upper position, the signals R and L will be added and a round characteristic is achieved. By changing the potentiometer 21, the round or eight characteristic will be successively passed into a cardioid characteristic.

The microphone described above and shown in FIGS. 2 and 3 is fully compatible and can be used together with prevailing balanced systems. A conventional power supply unit can be used. The control of the directivity characteristic can take place from the power supply unit or from a subsequent mixer comprising phantom feeding at a distance from the microphone without disturbing the prevailing recording. The fact that the control can take place at a distance from the microphones is appreciated when the microphones are placed in high stands or rigidly mounted at positions difficult to access. The Recording Personnel do not need to enter a sound insulated studio compartment but can make the adjustments from the mixer panel. A person skilled in the art realizes the enormous advantages achieved.

Another advantage is that it is now possible to make stereo recordings with a single microphone. The microphone consists of a double membrane unit 2 and 3 having cardioid characteristic directed at different directions 180° in relation to each other. Thus, the signal R essentially comprises sound information from the right side of the scene while the signal L essentially comprises sound information from the left side of the scene. Thus, if the signals R and L are fed to each channel of a tape recorder, a stereophonic recording is achieved. Possibly, the signals R and L can be mixed in a certain degree in order to avoid a cavity in the middle according to known recording technique. At this stereo application, so-called common-mode-rejection is not achieved and the hum can be disturbing at long wires and/or disturbed environments.

Figure 4:
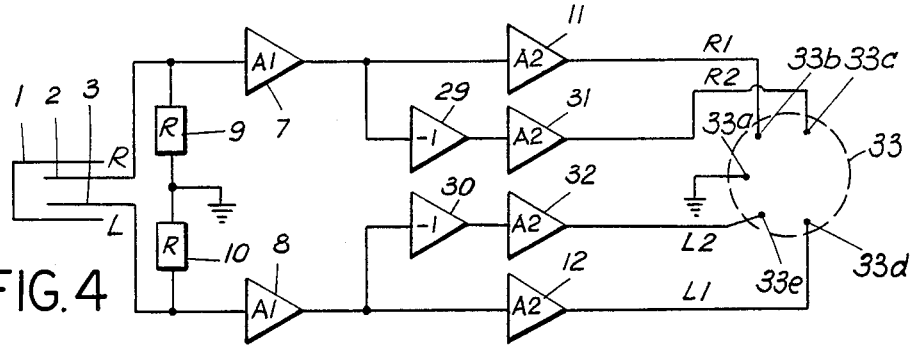
FIG. 4 is a circuit diagram of a second embodiment of the microphone having balanced outputs.

In FIG. 4 there is shown a circuit in which balanced signals are connected to four signal wires R1, R2, L1 and L2 and a screen. Like in FIG. 2, the microphone 1 comprises resistors 9 and 10 and amplifiers $A_1$ 7, 8 and $A_2$ 11, 12. Additionally, the output from the amplifier $A_1$ is connected to an inverting buffer 29, 30 and therefrom to buffers A2 31, 32. Thus, a signal R1 and an inverted signal R2 are achieved as well as a signal L1 and an inverted signal L2.

Figure 3:
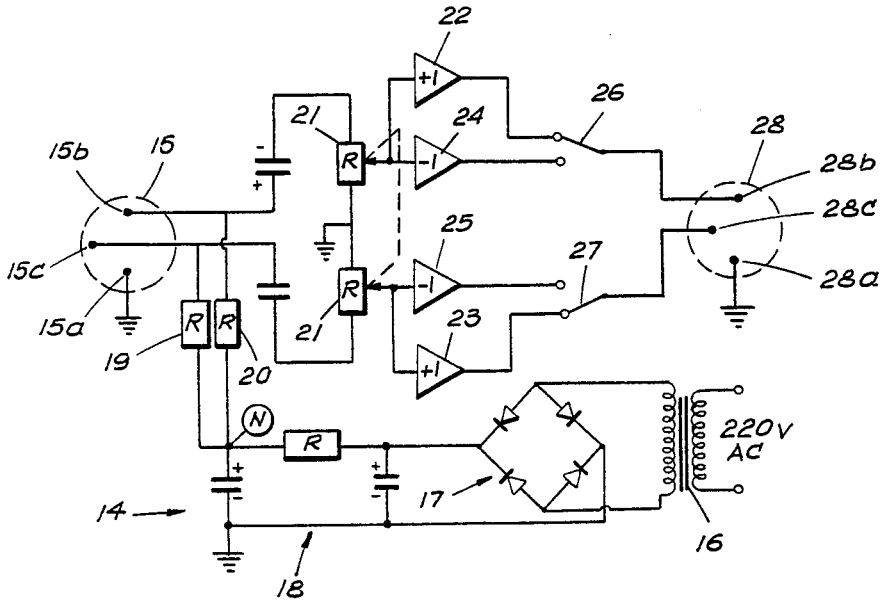
FIG. 3 is a circuit diagram of the power supply unit connected to the microphone of FIG. 2.
Figure 5:
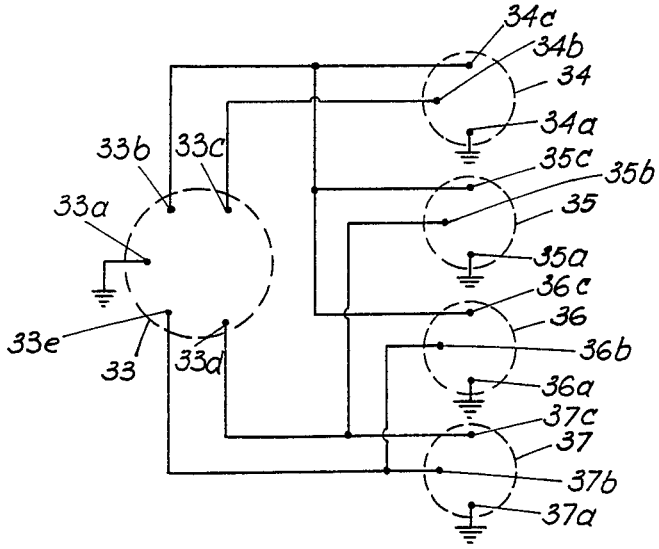
FIG. 5 is a circuit diagram combining the outputs of the microphone according to FIG. 5.

The signals R1, R2, L1 and L2 are connected through the signal wires to a power supply unit of the same type as in FIG. 3. In FIG. 5 there is shown how the signal is divided into four different connectors 34 to 37 from the input connector 33. The upper connector 34 gives channel I, i.e. signal R1, R2 and the lower connector 37 gives channel II, i.e. signal L1, L2, The connector 35 gives the sum of R and L, i.e. a round characteristic while the connector 36 gives the difference between R and L, i.e. and eight characteristic. By controlling the signals after the connectors 34 to 37, i.e. in a subsequent mixer, a continuously controllable sound image is achieved.

The amplifier stages as shown in FIGS. 2 and 3 deserve extreme care of several reasons. The space is limited since one normally desires a small microphone. The current consumption in the amplifiers of the microphone must not be too high. An amplifier having extremely small inherent noise and extremely high dynamic is required. All those requirements are difficult to achieve.

The space limitation means that an amplifier having a great number of discrete components cannot be regarded. Neither can integrated circuits of conventional design to be used above all due to a high current consumption. In this connection it must be pointed out that the current supply takes place through the two resistors 19, 20 of 6.8 kΩ in parallel in the power supply unit, i.e. though 3.4 kΩ. A current consumption of 1 mA means a decrease of voltage of 3.4 V which is acceptable. However, it must be realized that simultaneously the polarization voltage of the condenser microphone decreases from 48 V to 45 V, which gives a corresponding decrease of the signal strength and thus, the signal/-noise-ratio is decreased. Due to this reason heavy variations of the current consumption, which can modulate the signal and create distortion (intermodulation) should be avoided.

In the circuit according to FIG. 4, the amplifiers $A_2$ 11, 31 and the inverter 29 could be replaced by a transformer, which do not have a current consumption. This usually takes place in a traditional condenser microphone and gives the result that distortion arises in the bass as well as in the treble. Since the present microphone comprises two amplifiers, one for each membrane, the requirements of low current consumption will be still more stringent.

Figure 6:
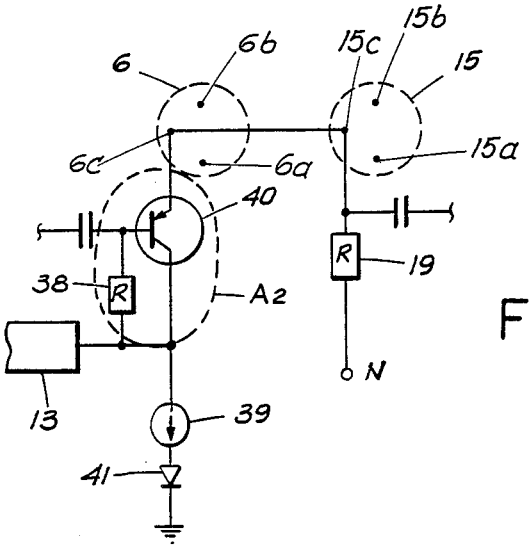
FIG. 6 is a circuit diagram of the impedance transformer A2 of FIG. 2 or FIG. 4.

According to the present invention this problem is solved by the fact that the amplifiers $A_2$, which are impedance transformers to a relatively low impedance and thus, normally requires a heavy current consumption, are constructed as emitter followers (source followers) and use the resistors 19, 20 of 6.8 kΩ of the power supply unit as emitter resistor. The amplifier A2 of FIG. 2 can be constructed according to FIG. 6. The resistor 38 of 1 MΩ controls the voltage $V_{CE}$ across the transistor 40 and a constant current regulator 39 is connected in the collector circuit in order to limit the current to e.g. a value of 0.4 mA. The collector of the transistor provides the voltage to the voltage regulator 13 which feeds the amplifiers $A_1$. Each amplifier $A_1$ has at least one FET transistor as an input stage. In order to give as small noise contribution as possible, this FET transistor should be driven with as low supply voltage as is practical. By the circuit described, the high feeding voltage of +48 V will be used twice by the fact that the impedance transformer $A_2$ and the amplifier $A_1$ are connected in series from the point of power supply, i.e. the same current passes through both transistor 40 and through the regulator 13 and thence the amplifier $A_1$. By means of the current regulator 39, the current consumption is limited to values allowed. In the circuit according to FIG. 4, the current regulator 39 can of course be common for the amplifiers $A_2$, i.e. amplifiers 11 and 31 in each half, since those stages have the mirror signals of each other. The amplifier $A_1$ and the regulator 13 have a relatively low current consumption, e.g. about 100 μA. The total voltage over the resistors 19, 20 of 6.8 kΩ will thus be 3.4 V, which is acceptable. At an increase of the load, this voltage will not rise, since the current regulator 39 will maintain the current consumption constant. In this way, the modulation of the polarization voltage is avoided.

The microphone can be supplied with a damping of 20 dB which should be positioned in the first amplifier $A_1$ in order to decrease the risk of overload. The damping can take place by connecting an unbypassed source resistor in the first FET transistor, which however increases the noise contribution considerably. However, this is not any drawback at the occasions when the damper should be used, since it is only needed at very heavy sound pressures when the noise is completely inaudible. It is also possible to lower the polarization voltage at high sound levels, whereby the signal will decrease in proportion to the polarization voltage.

At a practical embodiment according to the principals given above, a microphone having very excellent properties was achieved. The noise level was about 16 to 20 dBA and the dynamic was more than 120 dB. The current consumption was constantly about 1.15 mA in the embodiment according to FIG. 4 at voltages from 20 V to 50 V. By the elimination of transformers, a more clear and more distinct sound was achieved. By connection of connectors 34 to 37 to controls (including phase inverters) in a mixer it was possible to continuously vary the directional characteristics at a prevailing recording.

In order to keep track on which side is R respective L of the microphone, a light emitting diode (LED) is placed below the metal net of the microphone cover. The diode lights against the metal net meshes and the light is reflected neatly in all directions and indicates at the same time the fact that the microphone is connected. The diode 41 can be connected in the current regulator 39, in which it does not create an increased current consumption of the circuit. It is also possible to add a third membrane 42 in the microphone, which is turned away from the sound source, i.e. towards the background. It is sometimes desired to dampen the room sound from the back side, e.g. for dampening echoes or decreasing the reverberation. At the same time a better focusing of the sound source is achieved. The third membrane has its own amplifiers $A_1$ and $A_2$ and the signal is fed through the signal wire to the mixer table and is mixed in suitable proportions to the other two signals.

From the above it is realized that a new transformerless microphone having continuously variable directional characteristics has been disclosed. The principals described above can be modified by a person skilled in the art and embodied in many different ways. The invention is only limited by the patent claims below.

What I claim is:

1. An amplifier circuit for a condenser microphone system, said system comprising a condenser membrane unit having at least one membrane and providing an output signal;

said amplifier circuit comprising:

a power supply unit connected to said condenser membrane unit through a cable and providing a high polarization voltage on said cable through a resistor;

a first amplifier having a high impedance input and an output, said output signal being coupled to said high impedance input, said first amplifier generating an amplified signal at said output;

a unity gain second amplifier having an input connected to said output of said first amplifier and a low impedance output connected to said cable for transmitting the output signal of said second amplifier to said power supply unit, said second amplifier comprising an emitter follower having said resistor as its load resistor, said first and second amplifiers being connected in series with respect to said power supply; and a current regulator maintaining the current consumption of said second amplifier constant and independent of load or variations in the power supply voltage.

* * * * *